US009928974B1

(12) United States Patent
Zhang et al.

(10) Patent No.: US 9,928,974 B1
(45) Date of Patent: Mar. 27, 2018

(54) TERMINAL BARRIER ASSEMBLIES FOR ELECTRICAL SWITCHING APPARATUS AND METHODS OF ASSEMBLY THEREOF

(71) Applicant: Siemens Industry, Inc., Alpharetta, GA (US)

(72) Inventors: Fan Zhang, Suwanee, GA (US); Brian J. Rusch, Suwanee, GA (US); Carey D. Harnois, Grayson, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 15/267,377

(22) Filed: Sep. 16, 2016

(51) Int. Cl.

| | |
|---|---|
| ***H01H 9/02*** | (2006.01) |
| ***H01H 11/00*** | (2006.01) |
| *H01R 13/6593* | (2011.01) |
| *H01R 13/70* | (2006.01) |
| *H01R 13/516* | (2006.01) |
| *H01R 13/502* | (2006.01) |
| *H01H 1/58* | (2006.01) |
| *H01R 9/22* | (2006.01) |

(52) U.S. Cl.
CPC ..... *H01H 9/0264* (2013.01); *H01H 11/0031* (2013.01); *H01H 1/58* (2013.01); *H01H 9/02* (2013.01); *H01H 2009/0285* (2013.01); *H01H 2237/004* (2013.01); *H01R 9/223* (2013.01); *H01R 13/502* (2013.01); *H01R 13/516* (2013.01); *H01R 13/6593* (2013.01); *H01R 13/70* (2013.01); *Y10S 439/906* (2013.01)

(58) Field of Classification Search
CPC .... H01R 13/70; H01R 13/502; H01R 13/516; H01R 13/6593; H01R 9/223; H01H 1/58; H01H 2239/004; H01H 9/02; Y10S 439/906
USPC ..... 439/607.56, 731, 906, 465; 200/51 R, 200/304, 305, 284
See application file for complete search history.

(56) References Cited

U.S. PATENT DOCUMENTS

| | | | | |
|---|---|---|---|---|
| 3,213,241 | A | 10/1965 | Gelzheiser et al. | |
| 4,207,449 | A | 6/1980 | Robins | |
| 5,895,292 | A * | 4/1999 | Affeltranger | H01R 13/518 439/607.56 |
| 5,933,066 | A | 8/1999 | Chontas et al. | |
| 6,144,001 | A | 11/2000 | Green et al. | |
| 6,356,175 | B1 | 3/2002 | DeGrazia et al. | |
| 6,541,722 | B1 | 4/2003 | Whipple | |
| 2005/0109596 | A1 | 5/2005 | Quintanilla et al. | |
| 2005/0109597 | A1 | 5/2005 | Etscheidt et al. | |
| 2014/0151201 | A1 * | 6/2014 | Sisley | H01H 9/0264 200/293 |

(Continued)

*Primary Examiner* — Abdullah Riyami
*Assistant Examiner* — Justin Kratt

(57) ABSTRACT

A terminal barrier assembly for one or more terminals of an electrical switching apparatus, such as an electrical circuit breaker or switch. The terminal barrier includes a first barrier portion including a first opening portion, and a second barrier portion including a second opening portion. The first opening portion and second opening portion interface with one another to form a shielding aperture configured for shielding around one or more line wires extending from the one or more terminals. According to another aspect, an electrical switching apparatus including the terminal barrier assembly and methods of assembly of an electrical switching apparatus are provided, as are other aspects.

19 Claims, 8 Drawing Sheets

(56) References Cited

U.S. PATENT DOCUMENTS

| | | | | |
|---|---|---|---|---|
| 2015/0122626 | A1 | 5/2015 | Cho | |
| 2016/0148761 | A1* | 5/2016 | Parra | H01H 9/0264 200/304 |

* cited by examiner

TERMINAL BARRIER ASSEMBLIES FOR ELECTRICAL SWITCHING APPARATUS AND METHODS OF ASSEMBLY THEREOF

FIELD

The present disclosure relates to electrical switching apparatus, and more particularly to terminal barriers for electrical switching apparatus.

BACKGROUND

Electrical switching apparatus, such as circuit breakers, may include one or more electrical line terminals to which one or more line field electrical wires may be connected. In three-phase circuit breakers, for example, three line terminals may be included. During installation of the line-side terminal connection(s), the one or more field wires may be stripped, inserted into the terminal socket(s), and secured in place with terminal screw(s).

In operation, the circuit breaker ensures current interruption thereby providing protection to the electrical circuit from continuous over current conditions and high current transients due, for example, to electrical short circuits. To prevent electrical shock, sometimes, the line side of such circuit breakers may include a terminal barrier to prevent an installer/user/person from contacting any of the one or more stripped field wires and/or terminal screws.

However, such terminal shields are flawed in some aspects, as will be apparent from the following. Accordingly, there is a need for a terminal barrier that provides suitable terminal protection yet overcomes the problems of the prior art.

SUMMARY

According to a first aspect, a terminal barrier assembly for one or more electrical terminals of an electrical switching apparatus is provided. The terminal barrier assembly includes a first barrier portion including a first opening portion, and a second barrier portion including a second opening portion, wherein the first opening portion and second opening portion interface with one another to form a shielding aperture configured for shielding around a line wire extending from the one or more electrical terminals.

In accordance with another aspect, an electrical switching apparatus is provided. The electrical switching apparatus includes a molded case housing including a first end and a second end, one or more electrical terminals located at the first end, and a terminal barrier assembly coupled to the first end, comprising: a first barrier portion including a first opening portion, and a second barrier portion including a second opening portion, wherein the first opening portion and second opening portion interface with one another to form a shielding aperture configured for shielding around a wire coupleable to an electrical terminal of the one or more electrical terminals.

In accordance with another aspect, a method of assembling an electrical switching apparatus is provided. The method includes providing a molded case housing of the electrical switching apparatus including an end receiving one or more electrical terminals, and coupling a terminal barrier assembly to the end, the terminal barrier assembly including a first barrier portion including a first opening portion, and a second barrier portion including a second opening portion, wherein the first opening portion and second opening portion interface with one another to form a shielding aperture configured for shielding around a wire extendable from the one or more electrical terminals.

Still other aspects, features, and advantages of the present disclosure may be readily apparent from the following detailed description by illustrating a number of example embodiments, including the best mode contemplated for carrying out the present invention. The present invention may also be capable of other and different embodiments, and its several details may be modified in various respects, all without departing from the scope of the present disclosure. Accordingly, the drawings and descriptions are to be regarded as illustrative in nature, and not as restrictive. The invention is to cover all modifications, equivalents, and alternatives falling within the scope of the claims as appended below.

BRIEF DESCRIPTION OF DRAWINGS

The drawings, described below, are for illustrative purposes only and are not necessarily drawn to scale. The drawings are illustrative and not intended to limit the scope of the invention in any way. Wherever possible, the same or like reference numbers will be used throughout the drawings to refer to the same or like parts.

DETAILED DESCRIPTION

In one aspect, the terminal barrier assembly is operational to block off access to the stripped portion of the wire (e.g., a line-side wire otherwise referred to herein as a "line wire") and also to the one or more electrical terminals so that a user cannot come into contact with either the stripped portion of the wire or the electrical terminal. However, the wire may be of any number of different sizes (e.g., of different diameters). Prior art terminal barrier assemblies may be ineffective at providing a barrier of all possible sizes of line wires. Thus, in accordance with one aspect, a terminal barrier assembly is provided that accommodates different sizes of wires (e.g., line wires), yet still provides an adequate barrier and shock protection. Embodiments of the terminal barrier assembly may include flexible fingers that contact the wire. The flexible fingers may flex against an outside portion of the wire (e.g., against the wire insulation) upon entry into the terminal thus accommodating different sizes of wire. The terminal barrier assembly may be configured to accommodate wire sizes between about #3 AWG to about 300 kcmil copper or aluminum wire, for example.

In another aspect, it may be desirable to inspect the electrical terminal connection after a wire is installed into a terminal block and the terminal screw is secured. Thus, according to one or more embodiments, a terminal barrier assembly is provided that readily allows inspection of the terminal connection(s), such as electrical line wire connections to a line terminal(s). In particular, in one or more embodiments, a multi-piece terminal barrier assembly is provided. The multi-piece terminal barrier assembly may include a first barrier portion and a second barrier portion. The portions may interface with one another to form one or more shielding apertures that are configured to receive the terminal wire (e.g., line wire) therein when the wire is connected to the electrical terminal. The portions interface with one another and are separable from one another so that at least one of the portions is readily removable to allow for a visual inspection of the electrical terminal connection. In other embodiments, both of the portions are removable.

Terminal barrier assemblies, electrical switching apparatus including the terminal barrier assembly, and methods of assembling the terminal barrier assembly to an electrical switching apparatus according to one or more embodiments of the present invention are described below with reference to FIGS. 1A-6.

Figure 1A:
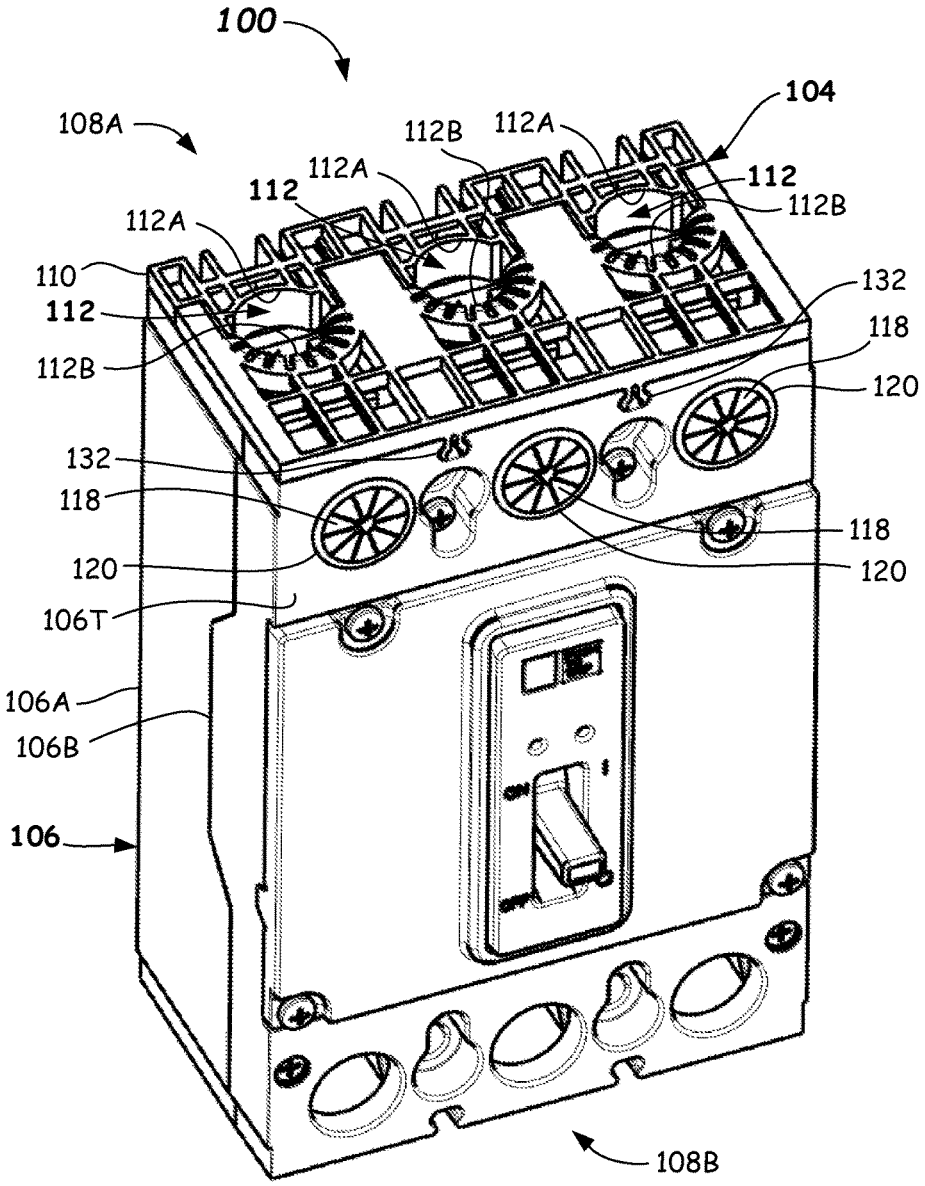
FIG. 1A illustrates an isometric view of an electrical switching apparatus (e.g., a circuit breaker) including a terminal barrier assembly coupled to a first end according to one or more embodiments.
Figure 1B:
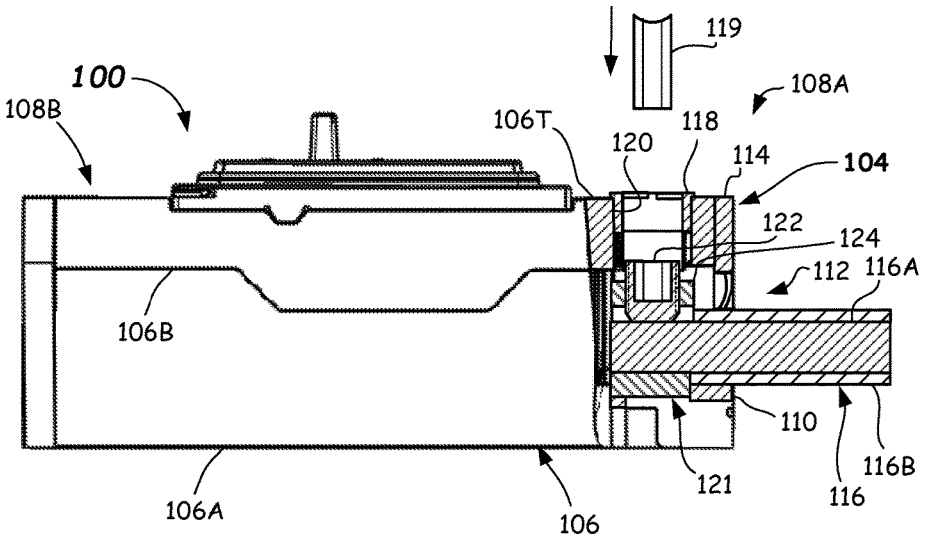
FIG. 1B illustrates a partial cross-sectioned side view of an electrical switching apparatus (e.g., a circuit breaker) including a coupled terminal barrier assembly according to one or more embodiments.

Referring now to FIGS. 1A and 1B, an isometric top view and partial cross-sectional side view, respectively, of an electrical switching apparatus 100 (e.g. a three-phase circuit breaker shown) including a terminal barrier assembly 104 provided in accordance with embodiments of the disclosure is illustratively shown. The electrical switching apparatus 100 includes a housing 106, which may be a molded case housing that may be made from any suitable molded plastic material, for example. The plastic material may be a thermoset material, such as a glass-filled polyester, or a thermoplastic material such as a Nylon material (e.g., Nylon 6), for example. Other suitable housing materials may be used. Flame retardant materials may be compounded into the plastic in some embodiments.

The housing 106 may be made up of any number of interconnecting housing sections. For example, two housing halves may make up the first housing portion 106A and the second housing portions 106B, which may be connected together (e.g., by rivets) to form the housing 106 and to form an internal cavity (not shown) for receiving an electrical contact assembly, tripping mechanism, and other electrical components (all not shown). Conventional circuit breaker components may include the electrical contact assembly, tripping mechanism, load terminal(s), a bimetal assembly, a latch, and a cradle, and a handle, which are entirely conventional and will not be explained in further detail.

In the depicted embodiment, the housing 106 includes a first end 108A and second end 108B. According to one or more embodiments of the invention, the terminal barrier assembly 104 may be configured for use with one or more terminals of an electrical switching apparatus 100. For example, in the depicted embodiment, the terminal barrier assembly 104 may be coupled to the first end 108A including one or more line terminals. However, it should be understood that the terminal barrier assembly 104 may be used on the second end in some installations, i.e., to provide a shielding barrier for load side electrical terminals.

The terminal barrier assembly 104 includes a first barrier portion 110 including a first opening portion 112A, such as adjacent to a bottom end, and a second barrier portion 114 including a second opening portion 112B, such as adjacent to a top end, wherein the first opening portion 112A and second opening portion 112B interface with one another to form one or more shielding apertures 112. The one or more shielding apertures 112 are configured for shielding around one or more line wires 116 extending from the one or more line terminals 118 as is shown in FIG. 1B. Line wires 116 may include a conducting metal portion 116A and a surrounding insulation 116B.

In the depicted embodiment, the terminal barrier assembly 104 includes three shielding apertures 112. However, the terminal barrier assembly 104 may include a lesser number of shielding apertures 112, such as two or more shielding apertures configured for shielding around two or more electrical wires (e.g., two or more line wires 116). For example, for a two-pole switching apparatus, such as a two-pole circuit breaker, two shielding apertures 112 may be provided. In another example, a single one of the shielding aperture 112 may be provided for a one-pole switching apparatus, such as a single-pole circuit breaker.

As illustrated, the electrical switching apparatus 100 may have coupled to it in addition to the terminal barrier assembly 104, terminal covers 118 that function to partially cover the one or more terminal access ports 120 provided on the top surface 106T of the housing 106. Terminal access ports 120 allow access and insertion of a tool 119 (e.g., a screwdriver, hex or square head tool, star tool, or the like) to tighten a terminal screw 122 into a line terminal block 124 as shown in FIG. 1B to secure the line wire 116. The terminal covers 118 include small cantilever beams, as shown, extending inwardly from an outer periphery that are rigid enough to prevent inadvertent entry of fingers, tools, wires into the terminal access ports 120. To insert a tool 119, the small cantilever beams must be deformed by the tool 119 and that takes a sufficiently large force that it cannot be done inadvertently. Thus, the terminal covers 118 make it difficult to contact the terminals 121.

Now referring to FIGS. 2A-2E, in order to secure the first barrier portion 110 and the second barrier portion 114 to the housing 106 of the electrical switching apparatus 100, one or both of the first barrier portion 110 and the second barrier portion 114 may include barrier retention features. The barrier retention features may interconnect with housing retention features formed on the housing 106 to secure the first barrier portion 110 and the second barrier portion 114 to the housing 106.

Figure 2A:
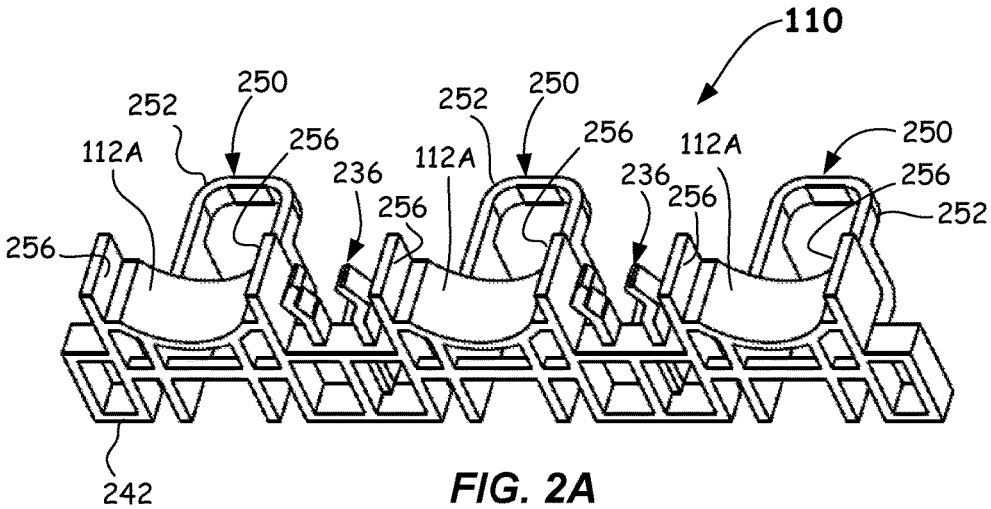
FIG. 2A illustrates a front isometric view of a first barrier portion of a terminal barrier assembly according to one or more embodiments.
Figure 2B:
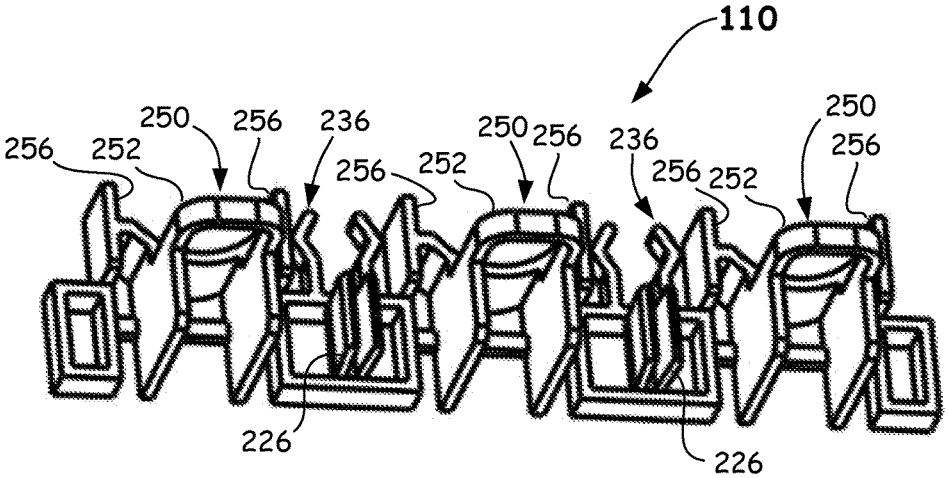
FIG. 2B illustrates a rear isometric view of a first barrier portion of a terminal barrier assembly according to one or more embodiments.
Figure 2C:
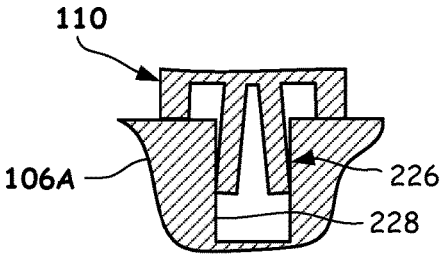
FIG. 2C illustrates a partial cross-sectional top view of a slide-in registration member of a terminal barrier assembly received in a housing retention feature according to one or more embodiments.
Figure 2D:
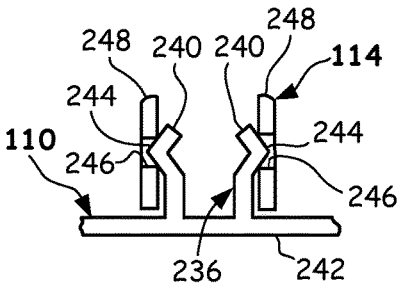
FIG. 2D illustrates a partial side view of a first barrier portion coupled to a second barrier portion via snap-connect features according to one or more embodiments.
Figure 2E:
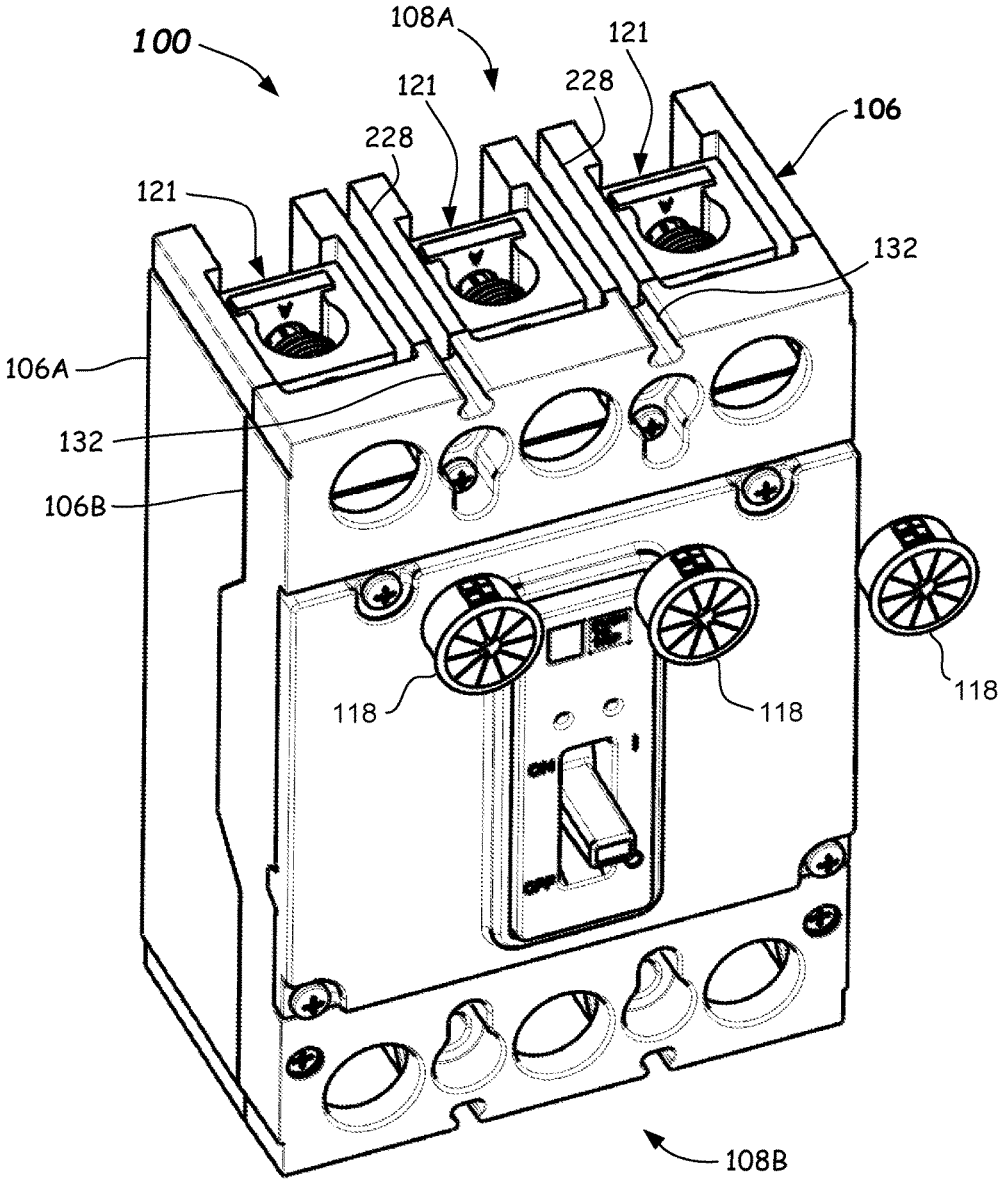
FIG. 2E illustrates a top isometric view of an electrical switching apparatus including housing retention features formed on a first end according to one or more embodiments.

For example, the first barrier portion 110 may include first slide-in retention members 226 (FIGS. 2B and 2C) configured and adapted to slide into first housing retention features 228 formed on the first housing portion 106A of the housing 106 of the electrical switching apparatus 100 (See FIGS. 2C and 2D). The first slide-in retention member 226 may include two cantilever beams that are received in a groove comprising the first housing retention features 228. The cantilever beams may diverge from one another and may be sized to provide a slight interference fit with the groove. For example, the groove may be approximately 4 mm wide and 45 mm long and may be oriented so that the groove extends from a bottom to a top of the first housing portion 106A at the first end 108A as shown in FIG. 2C. The cantilever beams may be flexed upon installation. The configuration of the first slide-in retention member 226 is such that it can be pushed into the groove from a direction perpendicular to the end surface of the housing 106.

Figure 3A:
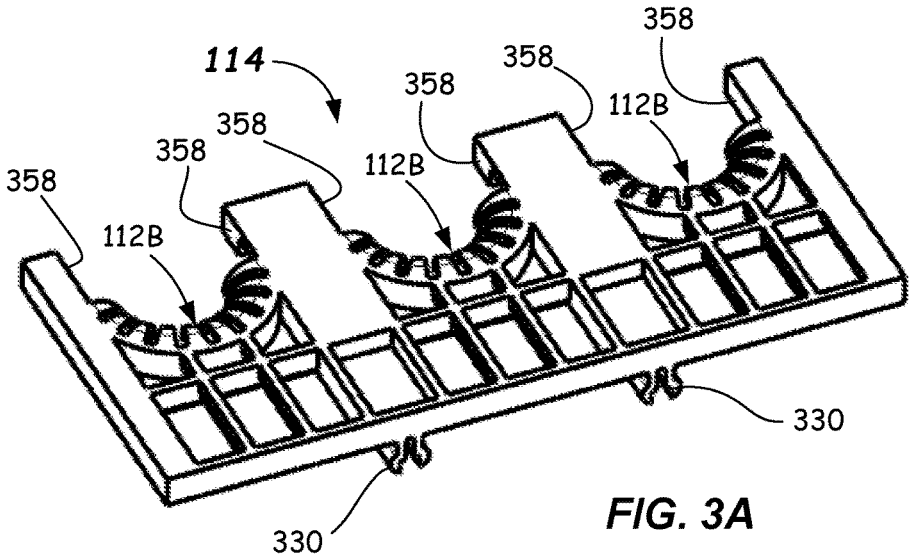
FIG. 3A illustrates a front isometric view of a second barrier portion of a terminal barrier assembly according to one or more embodiments.
Figure 3B:
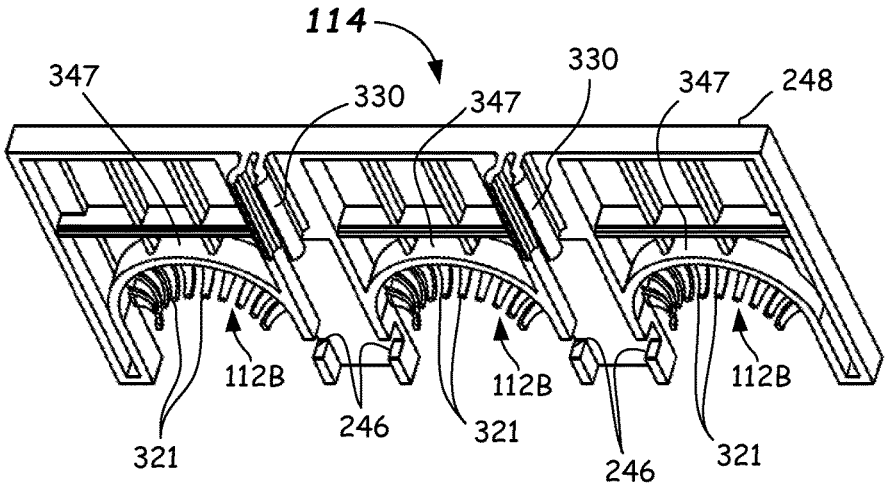
FIG. 3B illustrates a rear isometric view of a second barrier portion of a terminal barrier assembly according to one or more embodiments.
Figure 3C:
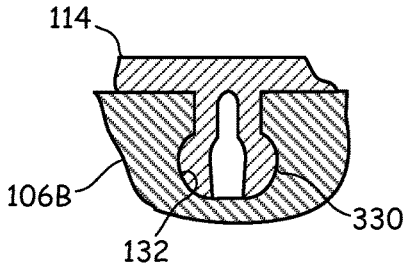
FIG. 3C illustrates a partial cross-sectional top view of a slide-in registration member of a second terminal barrier portion received in a housing retention feature according to one or more embodiments.

Similarly, as shown in FIGS. 3A-3C, the second barrier portion 114 may include one or more second slide-in retention members 330 that may be configured and adapted to slide into one or more second housing retention features 132 (See FIGS. 1, 2E, and 3C) formed on the second housing portion 106B of the housing 106 of the electrical switching apparatus 100. For example, the second slide-in retention members 330 may include an end portion having a larger dimension than a base portion thereof. The end portion may conform to a shape of the second housing retention features 132 such that the second barrier portion 114 may slide in from the top surface 106T of the housing 106 via a loose slip fit or a slight interference fit, for example. The fit may be such that the second barrier portion 114 may be removable to allow inspection of the wired connection to the terminal (e.g., line terminal 121).

Referring now to FIGS. 2A-2B and 2D, FIGS. 3A-3B, and 4A-4B, the connection between the first barrier portion 110 and the second barrier portion 114 will now be described. In particular, the connection between the first barrier portion 110 and the second barrier portion 114 may be by one or more snap-connect features. As shown, the snap-connect features may include one or more first snap-connect features 236 provided on the first barrier portion 110 and one or more second snap-connect features provided on the second barrier portion 114. The snap-connect features may be configured to be snapped together to secure together the first barrier portion 110 and the second barrier portion 114 thus forming the one or more shielding apertures 112.

The snap-connect features may include a configuration where one feature interacts with another feature to provide some level of retention. The retention should be reversible, i.e., not so significant that the second barrier portion 114 cannot be detached from the first barrier portion 110 relatively easily, such as by prying with a screwdriver or the like.

Figure 4A:
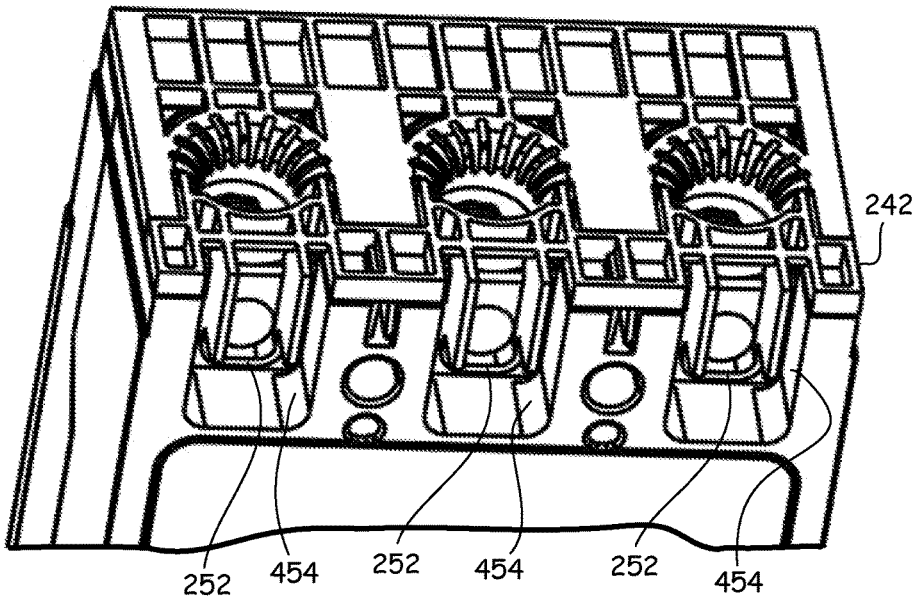
FIG. 4A illustrates a partial, bottom isometric view of a terminal barrier assembly installed on a first end of an electrical switching apparatus according to one or more embodiments.
Figure 4B:
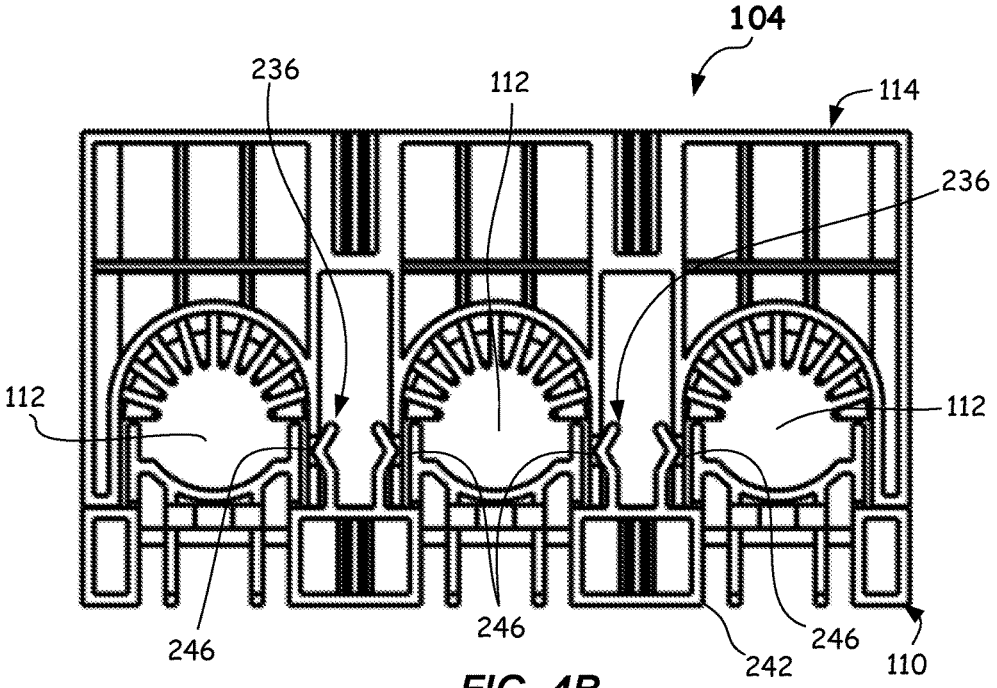
FIG. 4B illustrates a rear view of a terminal barrier assembly illustrating snap-connect features coupling the first terminal barrier portion to the second terminal barrier portion according to one or more embodiments.

As best shown in FIGS. 2D and 4B, in one or more embodiments, the one or more first snap-connect features 236 may include flexible beams 240, extending from a first body 242 of the first barrier portion 110. The flexible beams 240 may include first registry features 244 such as bent portions shown. The first registry features 244 may be flexed as installed and spring into second snap-connect features 246, such as recesses, formed in a second body 248 of the second barrier portion 114. Thus, the first snap-connect features 236 and the second snap-connect features 246 function to connect the second barrier portion 114 to the first barrier portion 110 and may also position them vertically relative to one another. The connection may be detachable to allow separation of the second barrier portion 114 from the first barrier portion 110 for inspection of the terminal connection. Other types of snap-connect features may be used.

As shown in FIGS. 2A and 2B, the first barrier portion 110 may also include lateral registration features 250. The lateral registration features 250 may be configured to laterally align and locate the first barrier portion 110 to the first housing portion 106A of the housing 106. For example, as is best shown in FIGS. 2A and 4A, hoops 252 of first body 242 may be received in pockets 454, which may aid with the alignment of the first slide-in retention members 226 with and into the first housing retention features 228 (See FIG. 2C).

Likewise, the second barrier portion 114 may include lateral registration features configured to laterally locate the first barrier portion 110 to the second barrier portion 114. For example, as shown in FIGS. 2A and 2B, first sidewalls 256 of the first barrier portion 110 may register laterally with second sidewalls 358 on the second barrier portion 114 as shown in FIG. 3A. First snap-connect features 236 and the second snap-connect features 246 may be positioned between the first sidewalls 256 when connected to one another.

Again referring to FIGS. 3A and 3B, the second barrier portion 114 is described in more detail. The second opening portion 112B of the second barrier portion 114 may include multiple flexible fingers 321. The flexible fingers 321 may be coupled to and extend inwardly from an arcing rib 347 of the second body 248 towards a common point. Flexible fingers 321 may include a taper along a length thereof. For example, the flexible fingers 321 may include a taper of a few degrees along their length with the widest portion being at the base where attached to the arcing rib 347. Multiple flexible fingers 321 may be provided for each shielding aperture 112 and may extend between about 0 and 90 around the second opening portion 112B. The flexible fingers 321 may be about 0.6 mm thick, about 3 mm wide at the base, and about 10 mm long, for example. Any suitable number of flexible fingers 321 may be used, such as between 3 and 20. Other dimensions of the flexible fingers 321 may also be used. The flexible fingers 321 may include a bend along their length so that free ends of the flexible fingers 321 extend towards the terminal(s). This may allow for easier entry of the line wire 116 into the shielding aperture 112. Flexible fingers like flexible fingers 321 may be provided in the first opening portion 112A, as well.

Figure 5:
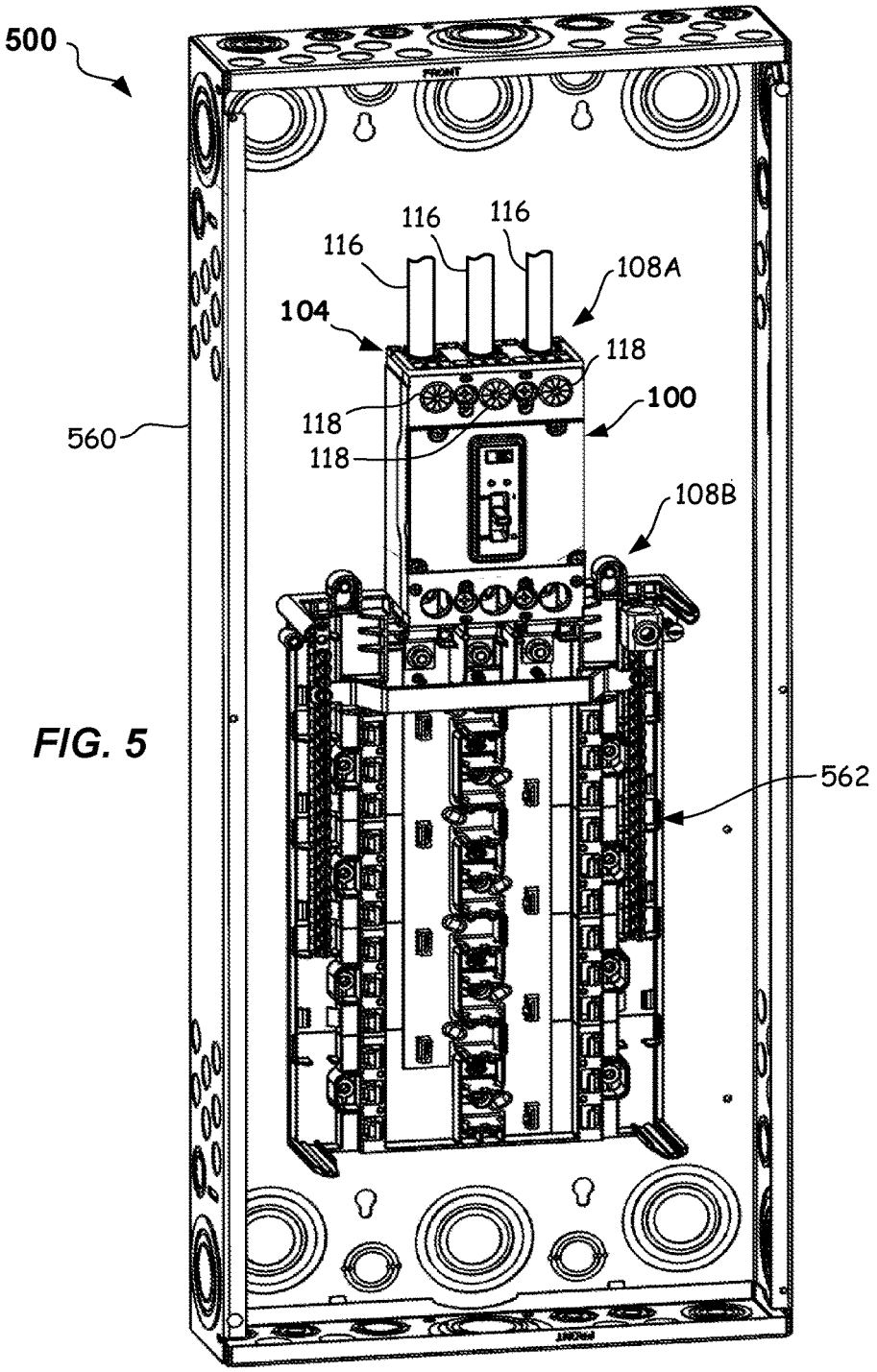
FIG. 5 illustrates a front isometric view of electrical switching apparatus including a terminal barrier assembly, wherein the electrical switching apparatus is coupled to a base panel of a load center according to one or more embodiments.

FIG. 5 illustrates an isometric view of an electrical load center assembly 500 including an electrical switching apparatus 100 with the terminal barrier assembly 104 mounted thereon. As depicted, the electrical switching apparatus 100 is shown installed in a panel enclosure 560. The second end 108B (the load-side end) of the electrical switching apparatus 100 (e.g., three-phase circuit breaker) is shown coupled to bus bars of a base panel 562. The first end 108A of the electrical switching apparatus 100 includes line terminals with line wires 116 (A, B, and C phase wires shown terminated) coupled thereto. The line terminals 121 and the conducting metal portions 116A (the stripped portions) of the line wires 116 are not shown because they have been effectively shielded by the terminal barrier assembly 104 and the terminal covers 118. As such, electrical contact with the terminal 121 or the conducting metal portion 116A of the line wires 116 by the user/installer is minimized or eliminated.

Figure 6:
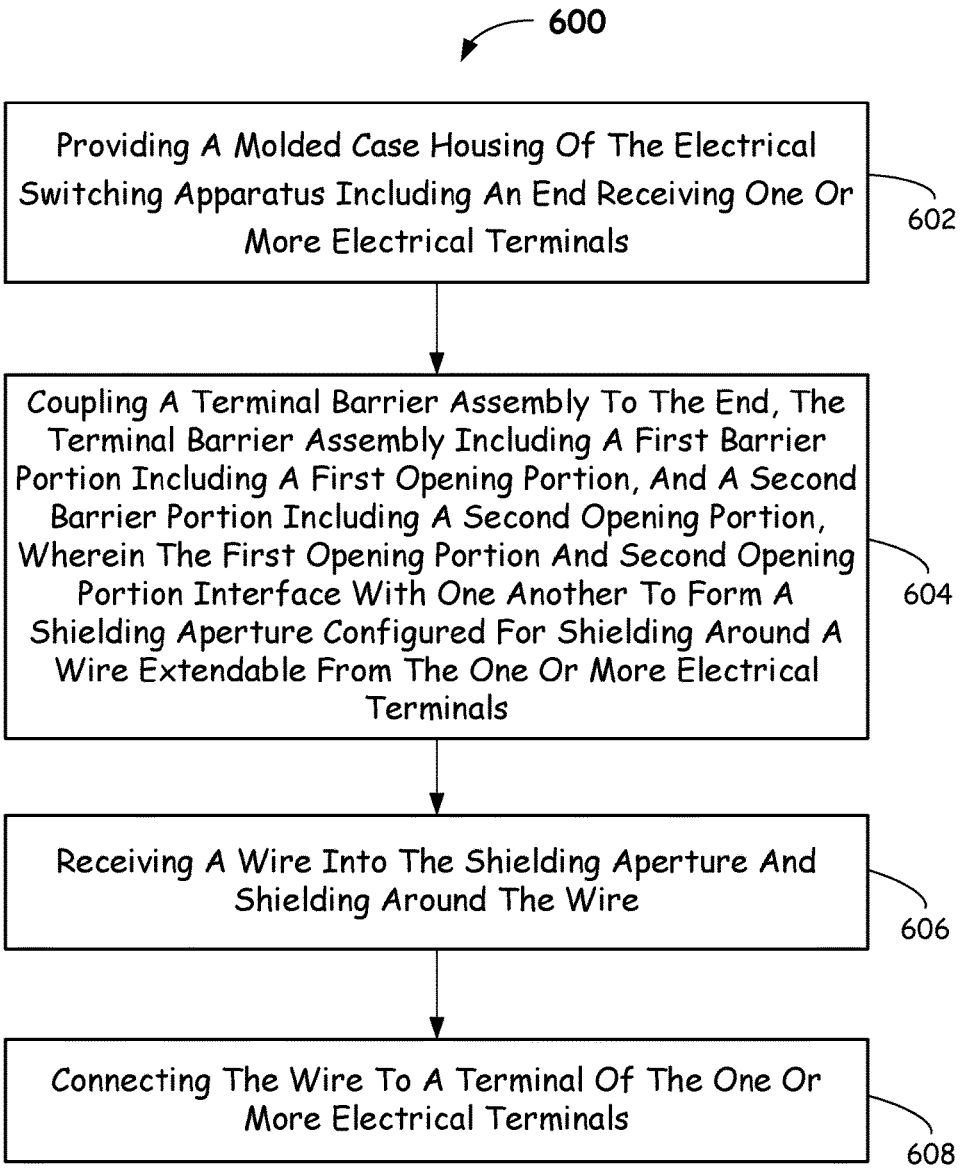
FIG. 6 illustrates a flowchart of a method of assembling a terminal barrier assembly to an electrical switching apparatus according to one or more embodiments.

According to another aspect, a method of assembling an electrical switching apparatus (e.g., electrical switching apparatus 100) is provided. As shown in FIG. 6, the method 600 includes, in 602, providing a molded case housing (e.g., molded case housing 106) of the electrical switching apparatus including an end (e.g., first end 108A) receiving one or more electrical terminals (e.g., one or more line terminals 121). However, it should be recognized that the invention may be used on a load end of the electrical switching apparatus 100, as well.

The method 600 further includes, in 604, coupling a terminal barrier assembly (e.g., terminal barrier assembly 104) to the end (e.g., first end 108A), the terminal barrier assembly (e.g., terminal barrier assembly 104) including a first barrier portion (e.g., first barrier portion 110) including a first opening portion (e.g., first opening portion 112A), and a second barrier portion including a second opening portion (e.g., second opening portion 112B), wherein the first opening portion and second opening portion interface with one another to form a shielding aperture (e.g., shielding aperture 112) configured for shielding around a wire (e.g., line wire 116) extendable from the one or more electrical terminals (e.g., line terminal 121).

The method 600 may further include, in 606, receiving a wire (e.g., line wire 116) into the shielding aperture (e.g., shielding aperture 112) and shielding around the wire (e.g., around line wire 116).

The method 600 may further include, in 608, connecting the wire (e.g., line wire 116) to a terminal of the one or more electrical terminals (e.g., line terminal 121).

The above method may be implemented in any order. For example, in some embodiments, the coupling of the terminal barrier assembly (e.g., terminal barrier assembly 104) to the end (e.g., first end 108A) in 604 may take place first, then the in 606, the wire (e.g., line wire 116) may be inserted into the shielding aperture (e.g., shielding aperture 112), followed by connecting the wire (e.g., line wire 116) to a terminal of the one or more electrical terminals (e.g., line terminal 121) in 608. Connection may be by securing a terminal screw 122 of the terminal 121 via the tool 119 received through the terminal cover 118.

In other embodiments, the connecting of the wire (e.g., line wire 116) to a terminal of the one or more electrical terminals (e.g., line terminal 121) in 608 may occur first, followed by a coupling the terminal barrier assembly (e.g., terminal barrier assembly 104) to the end (e.g., first end 108A). Thus, the first barrier portion (e.g., first barrier portion 110) including a first opening portion (e.g., first opening portion 112A), and the second barrier portion including a second opening portion (e.g., second opening portion 112B) may be installed around the wire, wherein the first opening portion and second opening portion interface with one another to form a shielding aperture (e.g., shielding aperture 112) shielding around a wire extending from the one or more electrical terminals (e.g., line terminal 121).

In other embodiments, the first barrier portion (e.g., first barrier portion 110) including a first opening portion (e.g., first opening portion 112A) may be first coupled to the first end 108A of the electrical switching apparatus 100, then the line wire 116 is connected to the terminal 121 in 608, then the a second barrier portion 114 including a second opening portion (e.g., second opening portion 112B) is coupled to the first end 108A, wherein the first opening portion and second opening portion interface with one another to form the shielding aperture (e.g., shielding aperture 112) shielding around a wire (e.g., line wire 116). In some embodiments, the second barrier portion 114 may be removed to allow an inspection of the electrical connections of the line wire or line wires 116 to the terminal or terminals 121.

While the invention is susceptible to various modifications and alternative forms, specific embodiments and methods thereof have been shown by way of example in the drawings and are described in detail herein. It should be understood, however, that it is not intended to limit the disclosure to the particular apparatus or methods disclosed, but, to the contrary, the intention is to cover all modifications, equivalents, and alternatives falling within the scope of the appended claims.

What is claimed is:

1. A terminal barrier assembly for one or more electrical terminals of an electrical switching apparatus, comprising:

a first barrier portion including a first opening portion and first slide-in retention members configured and adapted to slide into first housing retention features formed on a base portion of a molded case housing of the electrical switching apparatus, and a second barrier portion including a second opening portion, wherein the first opening portion and second opening portion interface with one another to form a shielding aperture configured for shielding around one or more line wires extendable from the one or more electrical terminals.

2. The terminal barrier assembly of claim 1, wherein the second barrier portion includes second slide-in retention members configured and adapted to slide into second housing retention features formed on a top portion of a molded case housing of the electrical switching apparatus.

3. The terminal barrier assembly of claim 1, comprising one or more first snap-connect features provided on the first barrier portion and one or more second snap-connect features provided on the second barrier portion and configured to be snapped together to secure together the first barrier portion and the second barrier portion.

4. The terminal barrier assembly of claim 3, wherein the one or more first snap-connect features comprise flexible beams extending from a body of the first barrier portion.

5. The terminal barrier assembly of claim 3, wherein the one or more second snap-connect features comprise recesses formed in a body of the second barrier portion.

6. The terminal barrier assembly of claim 3, wherein the first barrier portion and the second barrier portion include lateral registration features configured to laterally locate the second barrier portion to the first barrier portion.

7. The terminal barrier assembly of claim 1, wherein the second opening portion of the second barrier portion comprises flexible fingers.

8. The terminal barrier assembly of claim 7, wherein the flexible fingers extend inwardly towards a common point.

9. The terminal barrier assembly of claim 8, wherein the flexible fingers include a taper along a length thereof.

10. The terminal barrier assembly of claim 8, wherein a number of the flexible fingers associated with the shielding aperture is between 3 and 20.

11. The terminal barrier assembly of claim 1, coupled to an end of a molded case housing of the electrical switching apparatus.

12. The terminal barrier assembly of claim 1, comprising two or more shielding apertures configured for shielding around two or more line wires.

13. An electrical switching apparatus, comprising:

a molded case housing including a first end and a second end;

one or more electrical terminals located at the first end; and a terminal barrier assembly coupled to the first end, comprising:

a first barrier portion including a first opening portion, and a second barrier portion including a second opening portion, wherein the first opening portion and second opening portion interface with one another to form a shielding aperture configured for shielding around a wire coupleable to an electrical terminal of the one or more electrical terminals.

14. The switching apparatus of claim 13, wherein the first barrier portion and the second barrier portion each include slide-in retention members received into housing retention features formed in the molded case housing.

15. The switching apparatus of claim 13, wherein the second barrier portion is removable from the molded case housing.

16. The switching apparatus of claim 13, wherein the one or more terminals located at the first end comprise line terminals each configured to receive a line wire therein.

17. The switching apparatus of claim 13, wherein the second barrier portion comprises flexible fingers configured to accommodate different sized line wires.

18. The switching apparatus of claim 13, wherein the second end is coupled to a base panel of an electrical load center assembly.

19. A method of assembling an electrical switching apparatus, comprising:

providing a molded case housing of the electrical switching apparatus including an end receiving one or more electrical terminals; and coupling a terminal barrier assembly to the end, the terminal barrier assembly including a first barrier portion including a first opening portion, and a second barrier portion including a second opening portion, wherein the first opening portion and second opening portion interface with one another to form a shielding aperture configured for shielding around a wire extendable from the one or more electrical terminals.

* * * * *